US005303433A

United States Patent [19]

Jang

[11] Patent Number: 5,303,433

[45] Date of Patent: Apr. 19, 1994

[54] CONVERTIBLE ROCKING CRADLE

[76] Inventor: Shuh Y. Jang, No. 24-2, Wann Nian Lane, Yuan Lin, Changhua, Hsien, Taiwan

[21] Appl. No.: 81,121

[22] Filed: Jun. 25, 1993

[51] Int. Cl.[5] ..... A47D 9/02; A47D 9/04

[52] U.S. Cl. ..... 5/109

[58] Field of Search ..... 5/108, 109, 101; 128/33

[56] References Cited

U.S. PATENT DOCUMENTS

| | | | |
|---|---|---|---|
| 3,882,556 | 5/1975 | Accurso | 5/108 |
| 4,258,446 | 3/1981 | McAllister et al. | 5/109 |
| 5,210,893 | 5/1983 | Vosaki et al. | 5/600 |

*Primary Examiner*—Alexander Grosz
*Attorney, Agent, or Firm*—Browdy and Neimark

[57] ABSTRACT

A convertible rocking cradle is equipped with a mounting base and a cradle body that can be locked together or unlocked so as to permit the cradle body to be reciprocally rocked in the longitudinal direction by way of a motor; or the cradle body secured to the mounting base can be pushed all around. Each corner of the mounting base is disposed a wheel or castor so that it can be movable. On each longitudinal side of the mounting base is provided with a vertical F-shaped slide track which is engaged with the rollers disposed on the corresponding side of the cradle body. A motor with a gear mounted onto the shaft thereof is secured to the underside of the cradle body. A rack longitudinally disposed at the middle of the mounting base is in mesh with the gear driven by the motor so that the cradle body can be driven therealong. A limit switch located at ⅛ position from each end of the rack is used to make the motor reversely rotated so that the cradle can be reciprocally rocked in the longitudinal direction. A latch placed at each side of the cradle body is selectively engaged with a locking retainer, permitting the mounting base and the cradle body to be selectively combined together.

2 Claims, 5 Drawing Sheets

CONVERTIBLE ROCKING CRADLE

BACKGROUND OF THE INVENTION

The present invention relates to a convertible rocking cradle Which can be automatically hocked back and forth and can be converted into ah ambulant cradle if wanted.

The most common conventional rocking cradle can be used for only one single purpose, and is operated by manual force at a fixed place without moving around. Such cradle is rocked by hand so that a baby sitter or a mother must stick to the cradle all the time.

Another type of rockable cradle has been developed, as shown in FIG. 1, this kind of cradle is electrically operated. It has A cradle 10 hung between two triangular brackets 20 and is powered by a motor 30 in cooperation with a cam, permitting the cradle to reciprocally swing the cradle 10. This kind of rocking cradle must be powered by a high voltage and high current motor which is easily set on fire as a result of overheat in one aspect and the brackets are fixed in place so that the cradle is not movable.

SUMMARY OF THE INVENTION

Therefore, the primary object of the present invention is to provide a convertible rocking cradle which is operated in a safe and smooth manner.

One further object of the present invention is to provide a convertible rocking cradle which can be operated as a rocking cradle or can be converted into an ambulant cradle.

DETAILED DESCRIPTION OF THE PREFERRED EMBODIMENT

Figure 1:
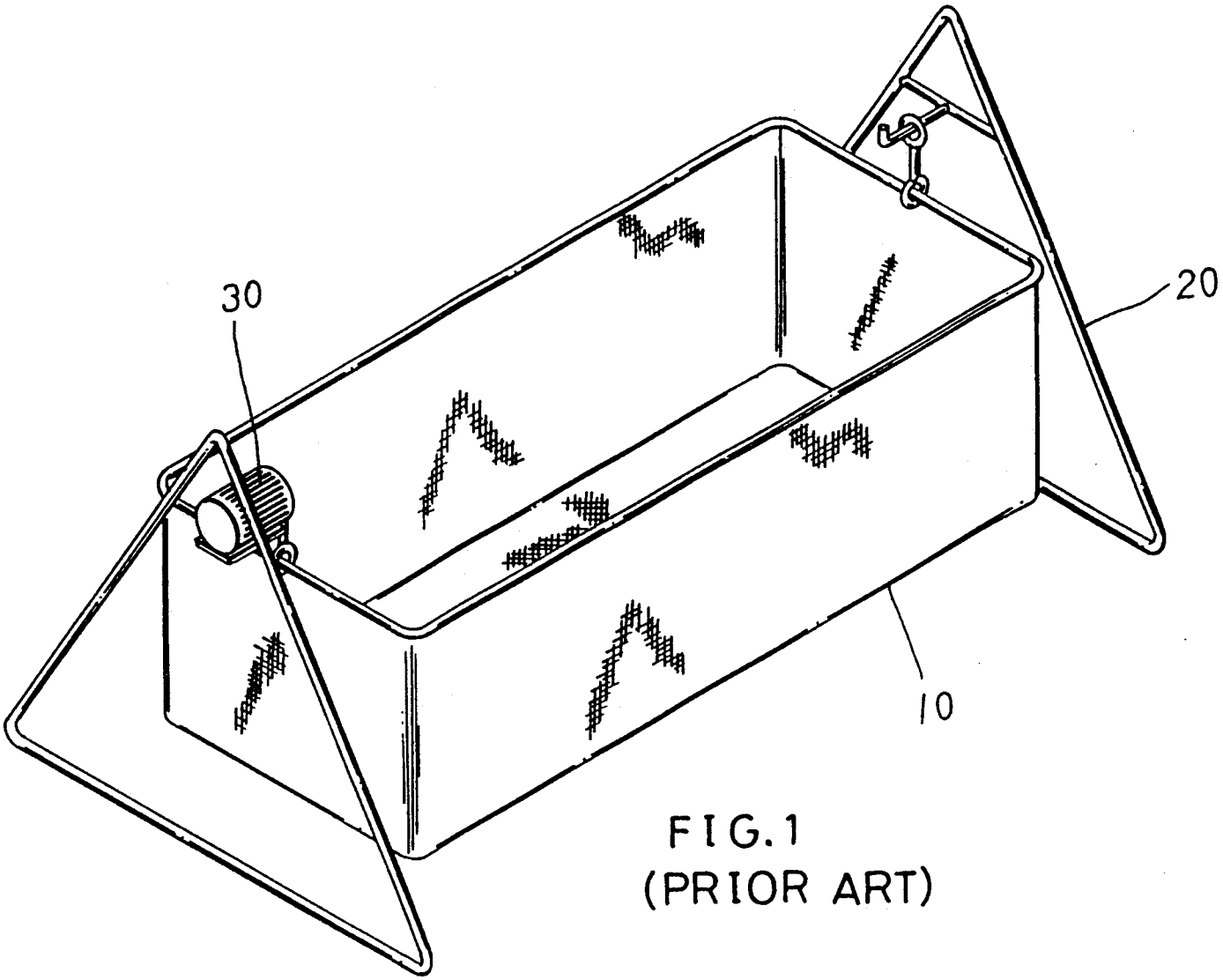
FIG. 1 (PRIOR ART)
FIG. 1 is a perspective diagram showing a conventional rocking cradle.
Figure 2:
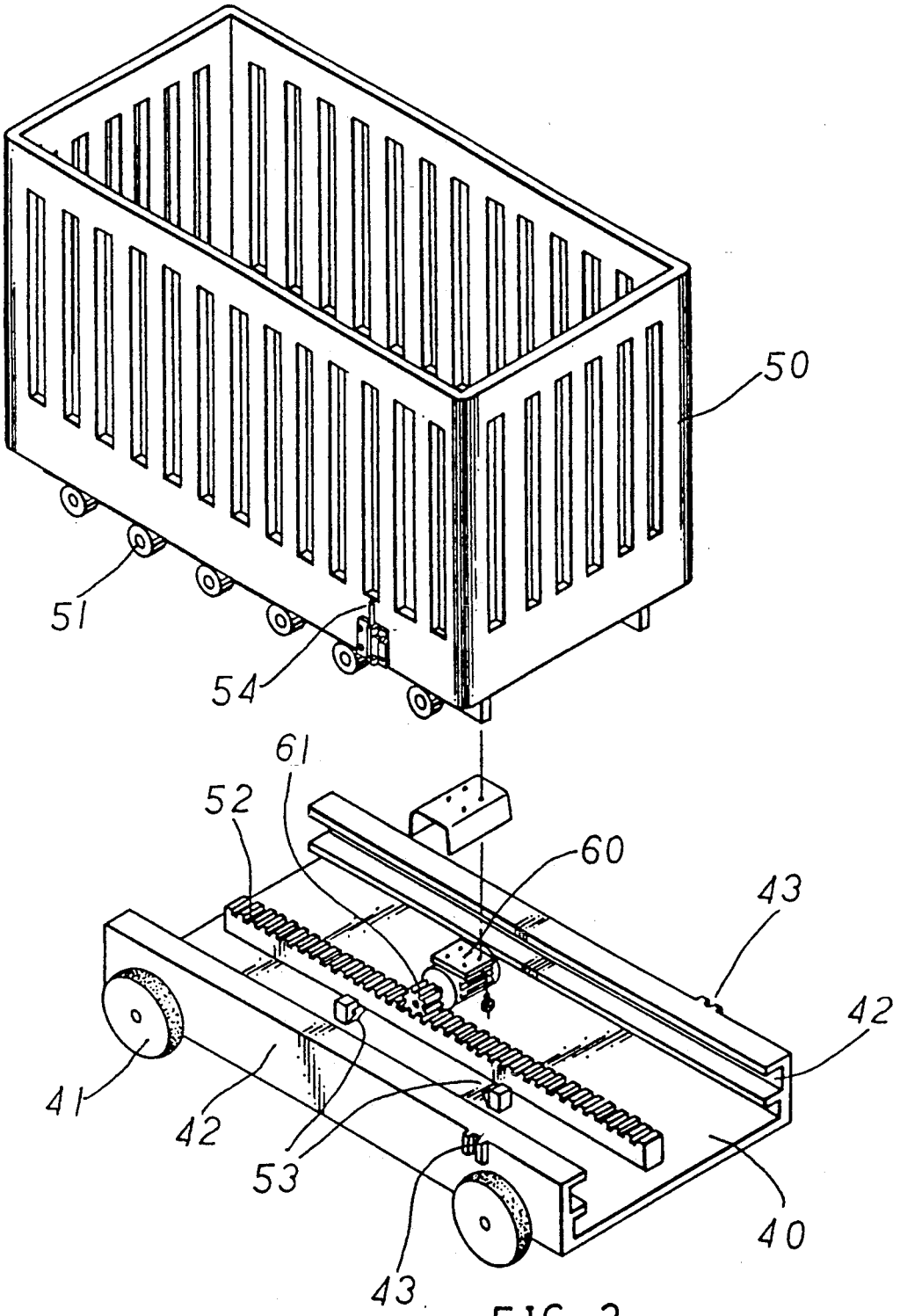
FIG. 2 is a perspective diagram showing the exploded components of the present invention.

Referring to FIG. 2, the convertible rocking cradle of the present invention is comprised of a mounting base 40 having four wheels 41 each disposed at the corner thereof respectively; a vertical F-shaped slide track 42 on each longitudinal side of the mounting base 40; and a cradle body 50 having a plurality of rollers 51 at each longitudinal side thereof.

Engaged with each F-shaped slide track 42 are the plurality of rollers 51 disposed at each side of the cradle body 50, permitting the cradle body 50 to be slidably moved back and forth along the slide tracks 42. A rack 52 extending the full longitudinal length of the mounting base 40 is engaged With a gear 61 mounted to the shaft of a motor 60 which is secured to the underside of the cradle body 50 so that the cradle body 50 can be driven to move.

Figure 3:
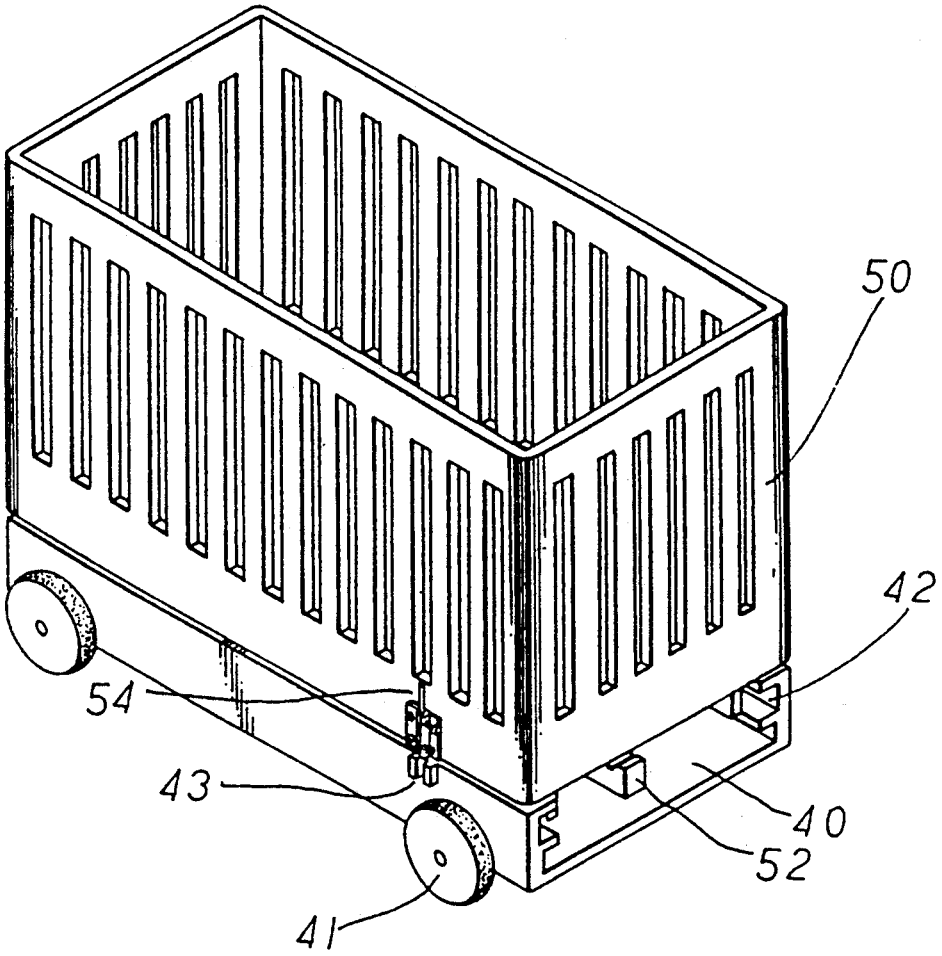
FIG. 3 is a perspective diagram showing the assembly of the present invention.

A reverse motion limit switch 53 is disposed at a position $\frac{1}{3}$ of the full length of the rack 52 so that the cradle body 50 can be made to move back and forth. A locking retainer 43 is disposed at each side of the mounting base 40, it is engaged with a latch 54 disposed at each side of the cradle body 50 so that the same can be secured firmly to the mounting base 40, as shown in FIG. 3.

Figure 4:
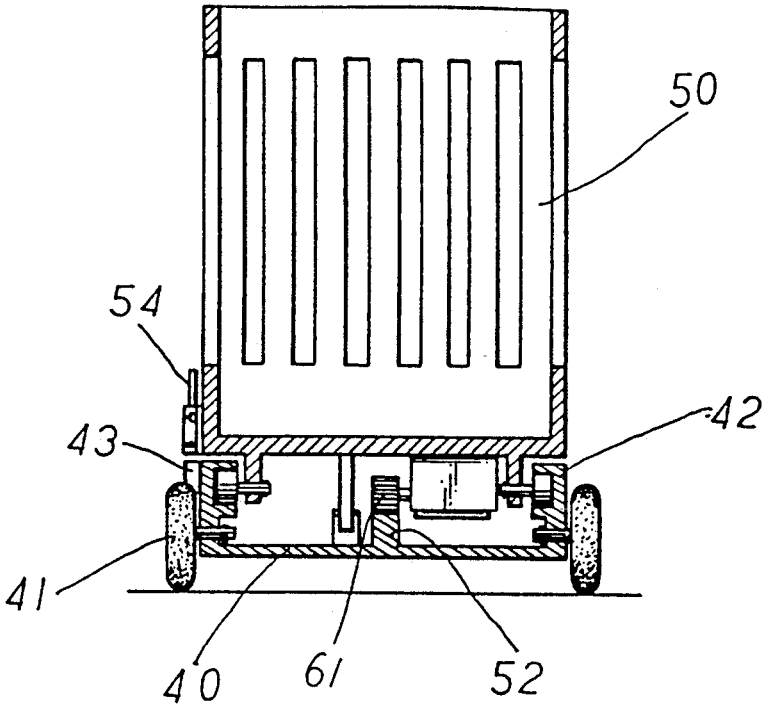
FIG. 4 is a front view of the present invention.

As the latches 54 are disengaged from the locking retainers 43, a switch can be turned on to make the motor 60 operate so that the cradle body 50 is driven, to move, back and forth between the two limit switches 53. As shown in FIG. 4, the cradle body 50 moves with its left and right ends extended at most $\frac{1}{3}$ over the ends of the mounting base 40 in each stroke.

Figure 4A:
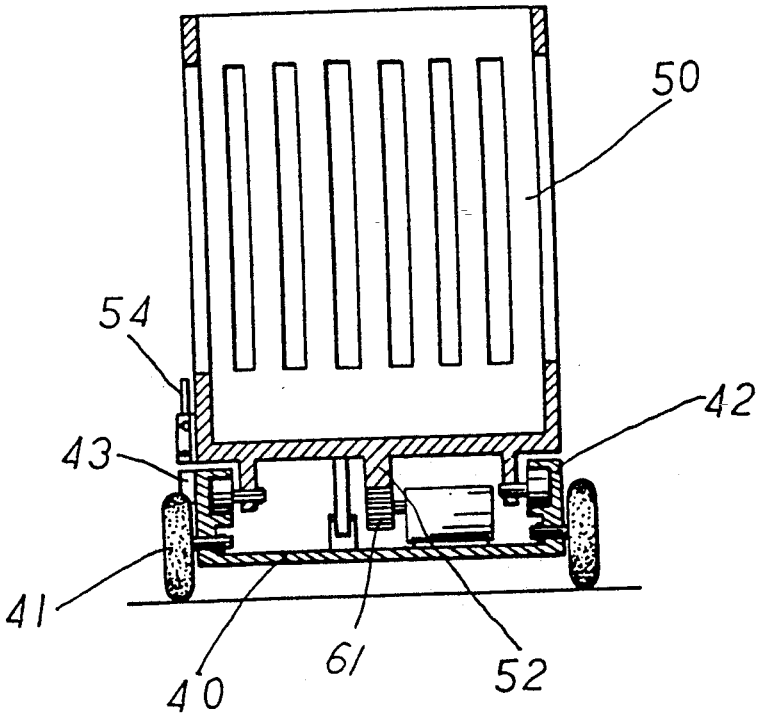
FIG. 4A is a diagram showing another design of the present invention in which the rack is disposed under the cradle body and the motor is secured to the mounting base.
Figure 5:
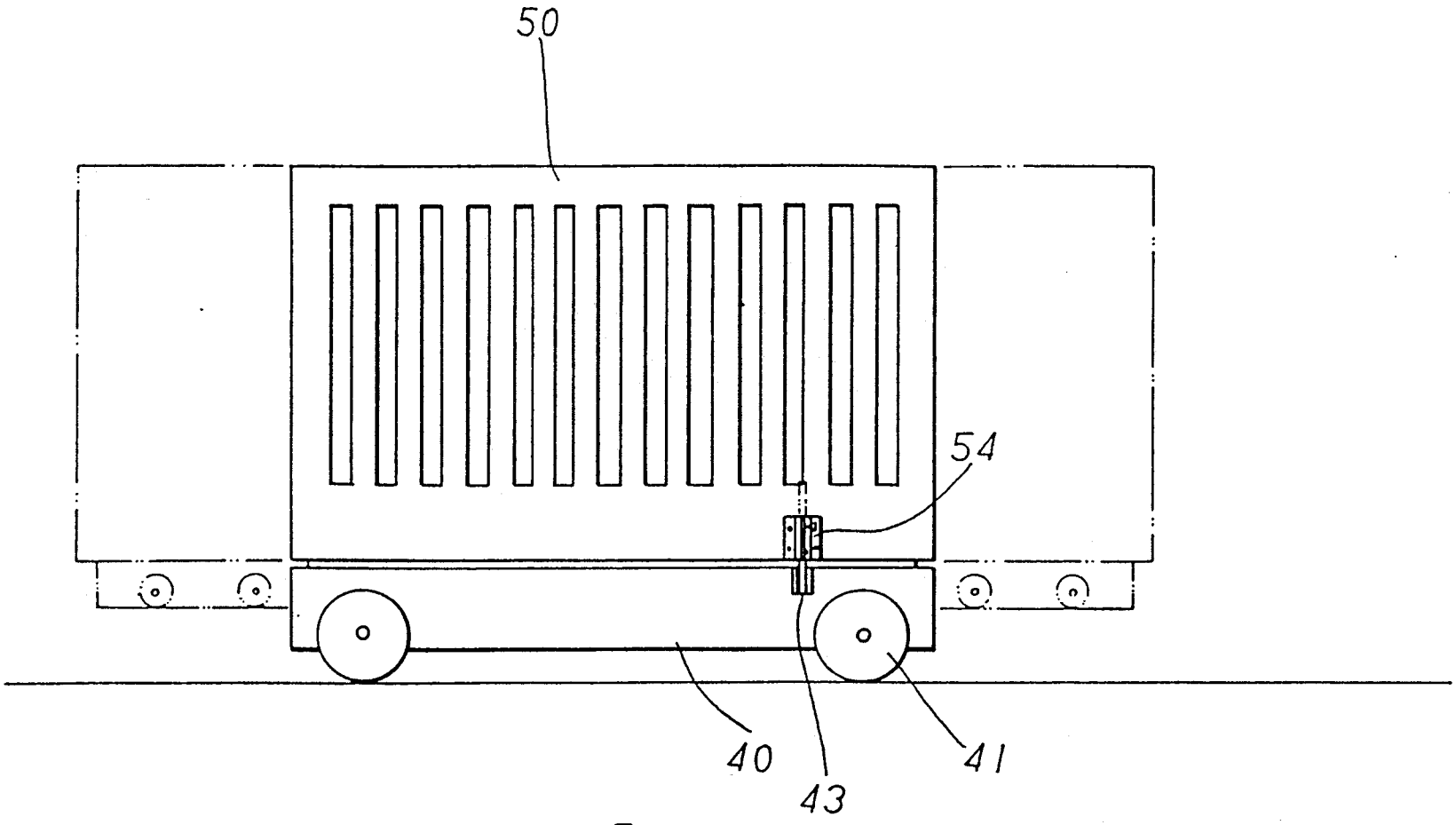
FIG. 5 is a diagram showing the motion of the cradle of the present invention.

As shown in FIG. 4A, the rack 52 can be disposed under the cradle body 50 in an alternative way and the motor 60 is secured to the mounting base 40 accordingly so that the rocking cradle can be operated in the same effect.

When the cradle body 50 is secured to the mounting base 40 by engaging the latches 54 with the respective locking retainer 43, the two can be combined together to convert the rocking cradle into an ambulant cradle, permitting it to be movable around.

I claim:

1. A convertible rocking cradle, comprising:

a mounting base;

a cradle body;

a motor secured to the underside of said cradle body having a driving shaft with a gear attached to the front end thereof;

a rack disposed at the middle of said mounting base in the longitudinal direction;

said gear of said motor being in engagement with said rack;

a number of wheeling means associated with said mounting base so as to make the same ambulant;

a vertical F-shaped slide track disposed on each longitudinal side of said mounting base;

a plurality of rollers being disposed on each longitudinal side of said cradle body and engaged with said F-shaped slide track so as to permit said cradle body to be moved therealong;

a pair of reverse motion limit switches each disposed at a specific position from each end of said rack, permitting said motor to be reversely operated when actuated each time;

a latch means disposed on each side of said cradle body;

a locking retainer disposed on each side of said mounting base being selectively engaged with each said latch means so as to permit said cradle body and said mounting base to be combined together or not.

2. A convertible rocking cradle as claimed in claim 1 wherein said rack can be secured to the underside of said cradle body and said motor is mounted to said mounting base.

* * * * *